United States Patent [19]

Williamson

[11] 4,000,771

[45] Jan. 4, 1977

[54] METHOD OF AND APPARATUS FOR CONTINUOUS CASTING

[76] Inventor: Calvin C. Williamson, 2083 Mandarin Drive, Costa Mesa, Calif. 92626

[22] Filed: July 27, 1973

[21] Appl. No.: 383,089

[52] U.S. Cl. ..... 164/64; 164/89; 164/283 MS

[51] Int. Cl.[2] ..... B22D 11/00

[58] Field of Search ..... 164/283 R, 64, 283 S, 164/283 MS, 283 MT, 89, 120

[56] References Cited

UNITED STATES PATENTS

| | | | |
|---|---|---|---|
| 3,099,053 | 7/1963 | Eliot | 164/64 |
| 3,499,456 | 3/1970 | Rerecich | 164/89 X |
| 3,536,127 | 10/1970 | Tafel | 164/89 X |
| 3,730,258 | 5/1973 | Easton | 164/89 X |

FOREIGN PATENTS OR APPLICATIONS

| | | | |
|---|---|---|---|
| 1,458,070 | 1/1969 | Germany | 164/64 |

*Primary Examiner*—Richard B. Lazarus
*Assistant Examiner*—John S. Brown
*Attorney, Agent, or Firm*—Gordon L. Peterson

[57] ABSTRACT

A method of continuously casting metal comprising feeding molten metal into an open-ended mold to form a billet, cooling the molten metal in the mold to form a solidified skin on the billet, withdrawing the billet from the mold, and applying external fluid pressure to the withdrawn portion of the billet. The external fluid pressure is sufficient to prevent breakout of molten metal through the skin, and the magnitude of the external pressure applied to one region of the billet is less than the magnitude of the external pressure applied to another region of the billet.

12 Claims, 2 Drawing Figures

METHOD OF AND APPARATUS FOR CONTINUOUS CASTING

BACKGROUND OF THE INVENTION

Continuous casting is a known process for casting various metals including both ferrous and non-ferrous metals into billets. In a conventional casting process, molten metal is tapped from a furnace into a ladle having a nozzle in its bottom wall. The nozzle can be opened and closed by various devices such as a stopper or sliding gate.

The molten metal is poured through the nozzle of the ladle into a tundish. The tundish also has a nozzle in its bottom wall, and molten metal is poured through the tundish nozzle into a mold. One purpose for the tundish is to control the flow rate of the metal into the mold.

The mold is generally water cooled, and the metal poured therein forms a strand or billet. A peripheral region of the molten metal solidifies to form a skin which surrounds the molten interior of the billet. As the billet is pulled through the mold, it is cooled further and the skin progressively thickens.

Before removal of the billet from the mold can be started, the skin must be sufficiently thick to support the molten metal within the billet. More specifically, the skin must be sufficiently strong to withstand the head of metal within the billet when it is removed from the support of the mold. If the skin is too thin, the molten metal breaks out through the skin. If the breakout is large, it becomes necessary to abort the cast.

An obvious partial solution to the breakout problem is to increase the rate of cooling of the billet thereby increasing the rate at which the skin thickens. Unfortunately, the billet cannot be cooled at a maximum rate because its properties deteriorate if this is done. Alternatively, the rate of billet movement, i.e., the speed of the casting operation could be reduced, and/or the length of the mold increased. However, neither of these are commercially desirable because each results in increased cost.

During a casting operation the billet is typically moved and guided by a series of rolls. The fluid pressure within the billet caused by the head of metal causes the skin to bulge between adjacent rolls. These bulges increase the power requirements to move the billet.

SUMMARY OF THE INVENTION

The present invention solves these problems while increasing the speed of the casting operation. This is accomplished, in part, by applying appropriate external fluid pressure to the portion of the billet withdrawn from the mold. The magnitude of the external fluid pressure is sufficient to eliminate or reduce breakouts and bulging. The amount of such fluid pressure is not the same for all of the withdrawn portions of the billet. Rather, a pressure gradient is provided which is tailored to the particular needs of the billet being cast. For example a lesser fluid pressure may be applied to an upper region of the billet, where the head of metal tending to cause breakouts is relatively low, and a greater fluid pressure may be applied to a lower region where the head of metal is greater.

The head of metal tending to cause rupture or bulging of the skin progressively increases from the upper to the lower end of the billet. Ideally the external fluid pressure should equal the internal fluid pressure at each point along the billet so that the skin would be subjected to a net fluid pressure of zero. Progressively increasing or decreasing of the fluid pressure along the billet can be relatively easily accomplished by changing the pressure in steps.

For a billet of known length, the desired external fluid pressures can be calculated for various locations along the billet. The minimum and maximum external fluid pressures desired will be at the upper and lower ends of the billet, respectively. If the minimum pressure level were applied along the full length of the billet, it would be insufficient to prevent breakouts at lower regions of the billet. If the maximum pressure were applied along all regions of the billet, it may tend to cause inward collapse of the skin near the upper end of the billet. Similarly, a compromise between the maximum and minimum pressure levels would provide, at best, some risk of rupture due to the internal or external pressures. Accordingly, for optimum results, the fluid pressure gradient should be carefully tailored in accordance with the needs of the billet being cast.

Another factor which may be considered in determining the external fluid pressure applied is skin thickness. The billet is cooled as it moves away from the mold, and therefore, the skin progressively thickens. If desired, the increasing skin thickness can be considered in determining the necessary external fluid pressure levels. However, in the interest of safety, it is preferred to simply balance the internal and external pressures insofar as practicable and ignore increasing skin thickness.

With this invention, the casting speed can be increased by increasing the length of the zone in which external fluid pressure is applied to the billet.

The fluid used to apply the external pressure to the billet can be in a liquid or gaseous state. Any fluid which will not have an adverse effect on the billet can be employed. For example air or nitrogen can be used.

To apply the external fluid pressure to the billet, the billet is pulled through a pressure vessel. The pressure vessel has a passage communicating with the lower end of the mold. The billet is received in the passage and pulled completely through the pressure vessel.

To allow for an appropriate pressure gradient along the length of the billet, the pressure vessel advantageously includes a plurality of pressure chambers. The billet passes through each of the pressure chambers. Conduit means supply fluid under pressure to each of the pressure chambers. Means are provided for controlling the pressure in each of the pressure chambers whereby individual pressure control in each of the chambers is obtained. This latter function can be carried out by providing a pressure regulating valve in communication with each of the pressure chambers to control the exhaust of pressurized fluid from the chambers.

The present invention also provides for controlling the rate of flow of molten steel into the mold. The container, which may be the ladle or tundish, is positioned above the upper end of the mold. A pouring chamber is interposed between the nozzle of the container and the upper end of the mold. To control the rate of flow of molten metal from the container to the mold, the pressure in the pouring chamber is appropriately controlled. This pressure acts in opposition to the head of metal in the container. Accordingly, by controlling the pressure in the pouring chamber the flow rate of metal into the mold is also controlled.

The pressurizing fluid for the pouring chamber must be selected so as not to react with the molten metal being poured through the pouring chamber. For example, an inert gas may be employed as the pressurizing fluid for the pouring chamber.

The pressure in the pouring chamber can be less than atmospheric if necessary to establish the desired flow rate. The concept of this invention relating to externally pressurizing the billet is usable with other techniques for controlling flow of metal into the mold.

In addition to controlling the flow rate of molten metal into the mold, the pressure in the pouring chamber increases the head or pressure tending to rupture the skin of the strand. Accordingly, when this method of flow control is used, use of the pressure chambers becomes even more important.

Because of the interaction between the pressure in the pouring chamber and the pressure in the pressure chambers, it is necessary that the magnitude of the pressure in the pressure chambers be related to the magnitude of pressure in the pouring chamber. The pressure in the pressure chambers should exceed the pressure in the pouring chamber. Under these circumstances each of the pressure regulating valves for the pressure chambers is regulated so as to maintain a pressure in the associated pressure chamber equal to the pressure in the pouring chamber plus a fixed amount depending upon the head of metal at the bottom of such chamber and the thickness of the thinnest portion of skin in the same chamber.

To prevent leakage of the relatively high fluid pressure from the pressure chambers upwardly through the mold to the pouring chamber, an intermediate chamber communicating with the lower end of the mold and the upper end of the pressure vessel is maintained at the same pressure as the pouring chamber. Thus, any leakage out of the pressure vessel upwardly toward the mold will be "vented" in this intermediate chamber. The intermediate chamber is not required if the pouring chamber is not pressurized; however, means for venting the external pressure between the mold and the pressure vessel should be provided to prevent the external pressure from traveling through the mold.

The invention can best be understood by reference to the following description taken in connection with the accompanying illustrative drawing.

DESCRIPTION OF THE PREFERRED EMBODIMENT

Figure 1:
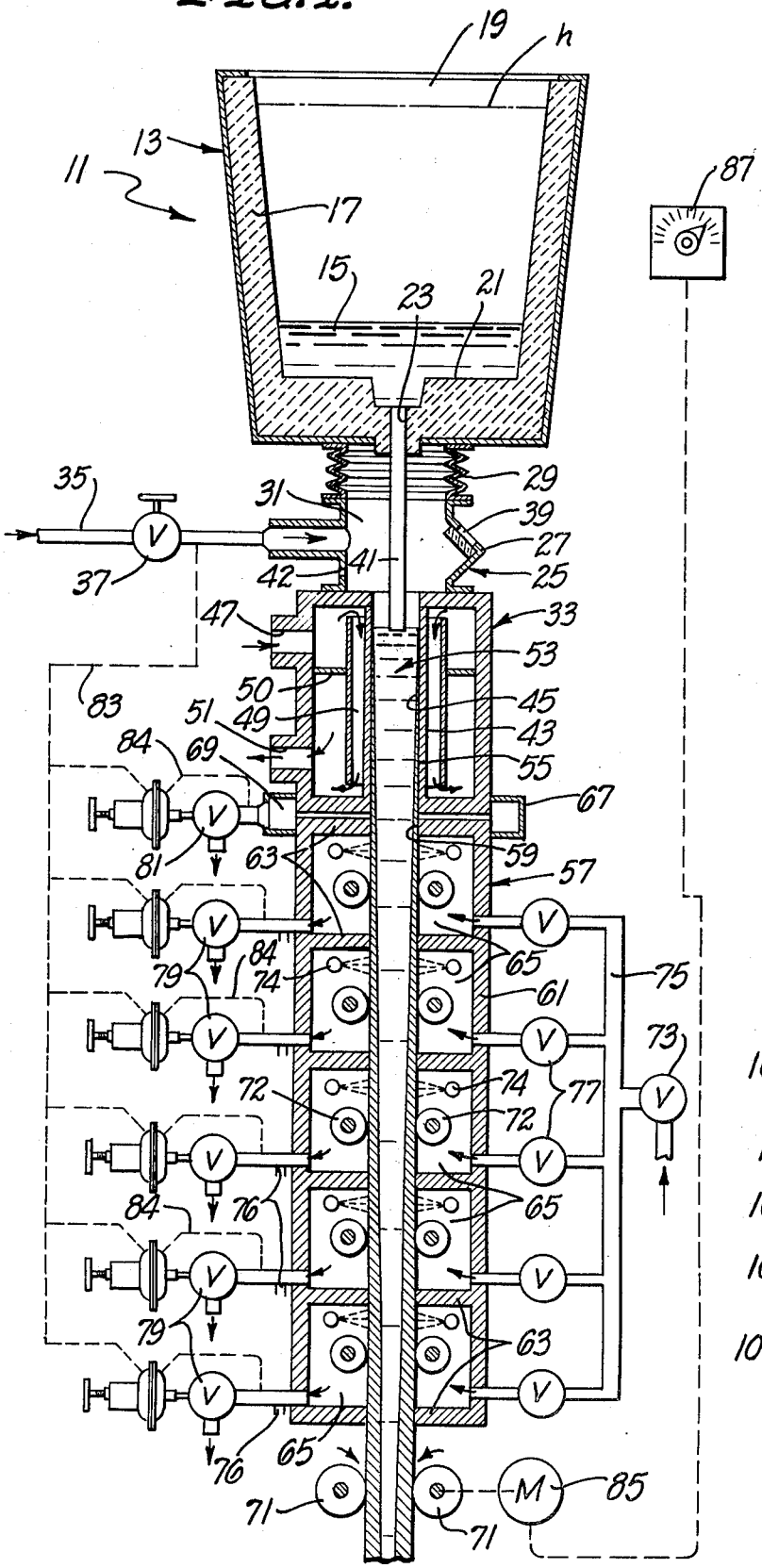
FIG. 1 is a schematic, elevational view partially in section of a continuous casting apparatus constructed in accordance with the teachings of this invention.

FIG. 1 shows a continuous casting apparatus 11. The casting apparatus 11 is particularly adapted for the continuous casting of ferrous metals; however, it may also be used for nonferrous metals.

The apparatus 11 includes a container 13 which may be a ladle or tundish. The container 13 is adapted to hold molten metal 15, and accordingly, it is equipped with a suitable lining such as a refractory lining 17. The container 13 has an open upper end 19 and a bottom wall 21. A nozzle 23 is formed in the bottom wall. The container 13 can be supported in a conventional fashion as by a crane or saddle.

A sleeve 25 which includes a metal fitting 27 and a bellows 29 defines a pouring chamber 31 between the bottom of the container 13 and the upper end of a mold 33. Fluid under pressure can be supplied to the pouring chamber 31 from a source (not shown) via a conduit 35 and a manually or automatically operable pressure regulator valve 37. The fluid thus admitted to the pouring chamber 31 must not react with or otherwise adversely affect the molten metal 15 and may be an inert gas such as argon. A sight glass 39 permits the operator to view a stream 41 of the molten metal flowing from the nozzle 23 into the upper end of the mold 33. A bleed aperture 42 is provided in the wall of the fitting 27.

The mold 33, which may be of conventional design, includes a tubular section 43 which defines a rectangular passage 45 for the molten metal. A suitable coolant such as water enters the mold 33 at an inlet 47 and flows through a passage 49 and out an outlet 51. Short circuiting of the coolant to the outlet 51 is prevented by a dam 50. The mold 33 is mounted in a conventional manner for reciprocation vertially through a relatively short stroke, such movement being accommodated by the bellows 29.

The molten metal in the mold 33 forms a strand or billet 53 of rectangular cross-section. The metal at the periphery of the billet 53 solidifies in the mold 33 and forms a skin 55, and the metal inside the skin remains molten.

A pressure vessel 57 is located beneath the lower end of the mold 33. The pressure vessel 57 defines a passage 59 which is coaxial with and projects vertically downwardly from the lower end of the passage 45. The passage 59 is rectangular and of substantially the same dimensions as the passage 45 so as to be adapted to receive the billet 53. The pressure vessel 57 is mounted for reciprocation with the mold 33.

The pressure vessel 57 includes a peripheral wall 61 and a plurality of transverse walls 63 which cooperate to define a plurality of pressure chambers 65. A bezel ring 67 cooperates with the lower end of the mold 33 and the upper end of the pressure vessel 57 to define an intermediate chamber 69. The billet 53 extends through the center of each of the pressure chambers 65 and effectively makes these chambers annular. The billet 53 is pulled through the mold 33 and the pressure vessel 57 by a plurality of pinch rolls 71. The billet 53 is guided in this movement by guide rolls 72.

The billet 53 is cooled in the pressure vessel 57 by a coolant, such as water, which is sprayed against the skin 55 by spray nozzles 74 located in each of the chambers 65. The water is drained out of the chambers 65 by suitable drains 76.

Each of the pressure chambers 65 is supplied with fluid under pressure, such as air, from a source (not shown) via a shutoff valve 73, distribution conduits 75, and flow control valves 77. One of the flow control valves 77 is provided for each of the pressure chambers 65. Each of the flow control valves 77 regulates the flow of fluid to the associated pressure chamber 65. The flow control valves 77 may be of conventional design, or may be in the form of an orifice.

The pressure within the pressure chambers 65 is controlled by pressure regulator valves 79, one of which is provided for each of the chambers 65. Each of the pressure regulating valves 79 discharges fluid from the associated pressure chamber 65 when the magnitude of the pressure in such chamber reaches a predetermined level. The interface between the billet 53 and the transverse walls 63 provides a leakage path between adjacent pressure chambers 65. Accordingly, the fluid will tend to leak from a pressure chamber 65 having relatively high fluid pressure to a pressure chamber having relatively lower fluid pressure. Appropriate seals (not shown) may be provided on the transverse wall 63 for engaging the billet 53 to minimize this leakage. The flow control valves 77 are preset so as to more than make up for any leakage out of the associated pressure chamber 65.

The pressure regulator valves 79 may be of conventional construction. A pressure regulator valve 81, which may be identical to the valve 79, is provided to limit the pressure within the intermediate chamber 69 to a preset maximum. This maximum pressure may be equal to the pressure in the pouring chamber 31; however, it preferably should not significantly exceed the pressure in the pouring chamber. Only leakage fluid is supplied to the intermediate chamber 69.

Each of the pressure regulator valves 79 provides individual control of the pressure in the associated pressure chamber 65. Thus, the pressure in each of the pressure chambers 65 can be controlled in accordance with the requirements of each casting operation. In the embodiment illustrated, each of the pressure regulator valves 79 vents fluid from the associated pressure chamber 65 when the pressure in such pressure chamber equals the pressure in the pouring chamber 31 plus a preset pressure which is a function of the maximum head of metal in that pressure chamber. To accomplish this each of the pressure regulator valves 79 is manually or automatically adjusted to provide a preset pressure which is related to the head of metal at the associated pressure chamber 65. In addition a control connection in the form of a control pressure line 83 extends from the conduit 35 downstream of the valve 37 to the control section of each of the pressure regulator valves 79. This provides each of the pressure regulator valves 79 with an input signal which varies in accordance with the pressure in the pouring chamber 31. Each of the pressure regulator valves 79 sums the manual input and input signal from the pressure line 83 in a conventional manner. The control section of each valve 79 is provided with a pressure feedback signal via a conduit 84. Thus, each valve 79 is provided with input indicating a desired pressure and with feedback indicating an actual pressure. Accordingly, each of the pressure regulator valves 79 opens when the pressure within the associated pressure chamber 65 exceeds the preset pressure increment for that chamber plus the pressure within the pouring chamber 31.

The control pressure line 83 also extends to the pressure regulator valve 81. This enables the pressure regulator valve to control the pressure within the intermediate chamber 69 so as to be no greater than the pressure within the pouring chamber 31.

The pinch rolls 71 are driven by a motor 85. The speed of the motor 85 is manually or automatically adjustable by a motor controller 87.

At the beginning of a cast, the level of molten metal within the container 13 may be at a level h indicated by the broken line near the upper end of the container. As the cast proceeds, the level of the molten metal 15 diminishes. As the level of molten metal 15 drops, the head of metal acting to force the metal through the nozzle 23 also decreases. Accordingly, if left uncontrolled, the flow rate of metal would decrease as the cast progresses.

In order to control the flow rate of the molten metal 15, the pressure within the pouring chamber 31 is appropriately controlled. Although the pressure within the pouring chamber 31 could be controlled in various different ways, in the embodiment illustrated, it is controlled manually by the valve 37. The operator adjusts the valve 37 as necessary to maintain the proper level of molten metal in the mold 33.

Figure 2:
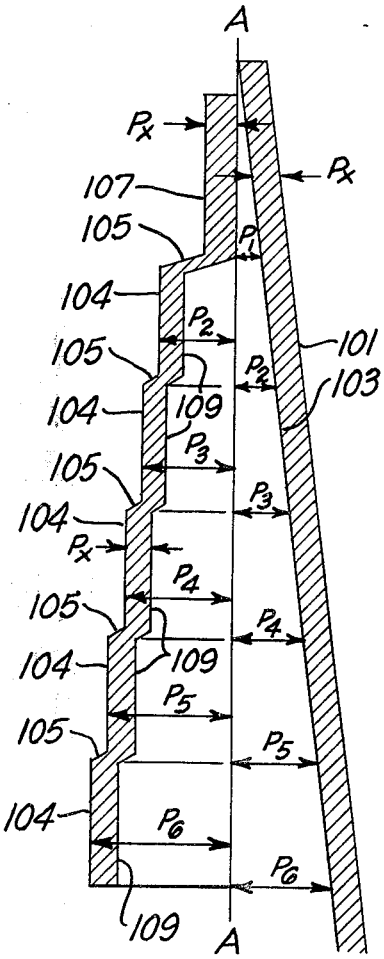
FIG. 2 is a pressure diagram showing typical fluid pressures in the pressure chambers and the billet.

FIG. 2 shows a typical pressure diagram for the casting apparatus 11. The portion of the diagram to the right of vertical axis A—A represents the static pressure within the skin 55 and the portion of the diagram to the left of the vertical axis A—A represents the static external fluid pressure applied to the skin 55. The vertical axis A—A represents vertical locations in the casting apparatus 11. At the top of the billet 53, the internal fluid pressure is substantially $P_x$, which is the pressure within the pouring chamber 31. Thereafter, the internal fluid pressure increases progressively as shown by the sloped line 101 as lower regions of the billet 53 are reached. The portion of the internal pressure created by the pressure $P_x$ is shown by the horizontal spacing between the line 101 and a dashed line 103.

In order to prevent breakout, the skin 55 must be sufficiently strong to resist the pressure shown by the line 101. While the billet 53 is within the mold 33, the walls of the mold provide support for the skin 55. As shown in FIG. 2, in the uppermost pressure chamber 65, there is an external pressure $P_2$, the magnitude of which is controlled by the associated regulator valve 79. External pressure $P_2$ equals the pouring chamber pressure $P_x$ plus a fixed pressure increment determined by the maximum head of metal in the uppermost chamber 65. Similarly, each of the pressure chambers 65 therebelow has progressively increasing external pressure levels $P_3 - P_6$, respectively. In each instance, the external pressure is equal to the internal pressure at the bottom of the associated pressure chamber 65, thereby assuring that breakouts and bulging will not occur. The cross-hatched and noncross-hatched portions of the internal and external pressures $P_2 - P_6$ represent the increments of these pressures due to $P_x$ and head of metal, respectively. If desired, it may be possible to decrease the external fluid pressures near the bottom of the pressure vessel 57 because of the increasing thickness of the skin 55.

With reference to FIG. 2, each of the pressure levels $P_2 - P_6$ is represented by a vertical line 104. The vertical lines 104 representing $P_2 - P_5$ are interconnected by sloping lines 105, each of which represents the pressure transition between each of these pressure levels. Physically, each of the pressure transitions represented by the lines 105 occurs across one of the transverse walls 63 separating adjacent pressure chambers 65. The axial dimension of one of the transverse walls 63 and/or of any seal carried thereby affects the rate of pressure change between the pressure chambers 65 on the opposite sides of such transverse wall. The axial dimension of any of the transverse walls 63 can be varied in accordance with the desired rate of pressure change between adjacent pressure chamber 63. Thus, by significantly increasing the axial dimensions of the transverse walls 63, the rate of external pressure change from the top to the bottom of the pressure vessel 57 can be made nearly linear, if desired.

in continuous casting operations, the skin 55 of the billet 53 will normally pull away from the wall of the passage 45 from a few inches below the top of the billet downwardly. Accordingly, the fluid pressure existing in the intermediate chamber 69 will also exist in the passage 45 at the regions of this passage where the skin 55 has pulled away from the wall of the mold 33. Thus, the pressure $P_x$ will exist in the intermediate chamber 69 and in a portion of the mold 33, as shown by the vertical line 107 in FIG. 2.

It should be understood that the pressure $P_x$ in the pouring chamber 31 varies during a cast. The line 103 in FIG. 2 represents the internal pressure acting on the skin 55 when $P_x$ = O or other minimum value, and the line 101 represents the internal pressure when $P_x$ is at a maximum. Similarly, the pressure levels $P_2 - P_6$ vary from a maximum value represented by the lines 104 when $P_x$ is maximum to a minimum value represented by lines 109 when $P_x$ is at a minimum.

In operation of the apparatus 11, molten metal such as steel is poured into the container 13 in a conventional manner. The container 13 is placed in contact with the upper surface of the bellows 29 to form a seal. The valve 37 is manually set to provide a desired pressure level within the pouring chamber 31. The shut-off valve 73 is opened to pressurize the pressure chambers 65. A starting bar (not shown) is inserted up through the pressure chamber 65 and into the bottom end of the mold 33. A gate or stopper (not shown) is removed from the nozzle 23 of the container 13 to allow the stream 41 of molten metal to flow through the nozzle 23 into the mold 33 and solidify around the upper end of the starting bar near the bottom of the mold 33. As molten metal continues to flow into the mold 33 from the stream 41, the molten metal 53 in the mold rises to a level a few inches from the top of the mold, at which level the drive motor 85 is started to operate the pinch rolls 71. Simultaneously with starting of the drive motor 85, cooling water is supplied to the nozzle 74 to cool the skin 55 of the descending billet 53 as it is pulled through the pressure chamber 65.

At the beginning of the casting operation, the molten metal within the container 13 is at a maximum level h, and therefore, tends to provide a maximum rate of flow of metal into the mold 33. As the cast progresses, this head decreases. Consequently, if uncontrolled, the flow rate of the metal into the mold 33 would be at a maximum at the beginning of the cast, and gradually diminish as the cast progresses.

To control the flow rate of metal into the mold 33, the valve 37 is manually regulated to provide a maximum pressure in the pouring chamber 31 at the beginning of the cast. As the cast progresses, the valve 37 is progressively manually closed to reduce the pressure level in the pouring chamber 31. Pressure reduction in the pouring chamber 31 is made possible by the bleed aperture 42. The operator controls the valve 37 in accordance with the level of molten metal in the mold 33. Accordingly, the pressure differential across the nozzle 23 is established to maintain the desired flow rate of metal into the mold 33.

During the cast the pressure levels $P_2 - P_6$ are automatically maintained within the corresponding pressure chambers 65 by the associated pressure regulator valve 79. Each of the pressure levels $P_2 - P_6$ is reduced during the cast as, and to the extent that, the pressure in the pouring chamber 31 is reduced. Most of the external surface of the billet 53 is not mechanically supported and is pressurized by the fluid pressure in the pressure chambers 65 sufficiently to avoid breakouts and bulging.

To terminate the cast, the pressure in the pouring chamber 31 is increased until the molten metal in the stream 41 ceases to flow from the nozzle 23. Simultaneously, the drive motor 85 is stopped. The pressure within the pouring chamber 31 is maintained until the molten metal in the nozzle 23 solidifies, at which time the pressure in the pouring chamber 31 can be reduced, and the drive motor 85 energized to withdraw the remainder of the billet 53 from the apparatus 11. An alternate method of terminating the cast is to replace the stopper or gate (not shown) into the nozzle 23.

It should be understood that the pressure vessel 57 can be used with different methods and devices for controlling the flow rate of metal into the mold 33. Similarly, although the mold 33 and the pressure vessel 57 are linear and arranged vertically, other configurations and arrangements such as a curved mold may be utilized.

Although an exemplary embodiment of the invention has been shown and described, many changes, modifications and substitutions may be made by those skilled in the art without necessarily departing from the spirit and scope of this invention.

I claim:

1. A method of continuously casting metal comprising:

pouring molten metal through a nozzle into a pouring chamber;

flowing the molten metal in a stream through the pouring chamber and into an open-ended mold to form a billet;

controlling the pressure in the pouring chamber to thereby control the flow rate through the nozzle;

cooling the metal in the mold to form a solidified skin on a peripheral region of the billet;

withdrawing the billet from the mold with the metal within the solidified skin being molten; and applying external fluid pressure to at least a portion of the billet withdrawn from the mold to prevent the molten metal of such portion of the billet from breaking through the skin.

2. A method as defined in claim 1 wherein the external fluid pressure at least at one region on the billet is greater than the fluid pressure in the pouring chamber.

3. A method as defined in claim 1 wherein a first region of the withdrawn portion of the billet is above a second region of the withdrawn portion of the billet and said step of applying includes applying external fluid pressure to the first and second regions of the billet with the magnitude of the pressure applied to the first region being different from the magnitude of the pressure applied to the second region.

4. A method as defined in claim 3 including providing first and second pressure chambers surrounding said first and second regions of the billet and said step of applying includes introducing fluid under pressure into said pressure chambers and controlling the pressure of the fluid in each of said pressure chambers.

5. A method as defined in claim 4 wherein said cooling includes spraying a coolant against the first and second regions in the first and second pressure chambers, respectively.

6. A method as defined in claim 1 wherein the external fluid pressure applied to at least a portion of the billet during the step of applying exceeds the pressure in the pouring chamber and including maintaining the zone adjacent the location where the billet is withdrawn from the mold at a pressure no greater than about the pressure in the pouring chamber to prevent the relatively high pressure acting on said portion of the mold from leaking into the pouring chamber.

7. A method as defined in claim 6 wherein a first region of the withdrawn portion of the billet is above a second region of the withdrawn portion of the billet, said step of applying includes applying external fluid pressure to the first and second regions of the billet with the pressure applied to the first region being less than the pressure applied to the second region, the magnitude of the fluid pressure applied to the first region and the second region being greater than the magnitude of the pressure in the pouring chamber, and said nozzle being in the wall of a container adapted to have molten metal therein.

8. A method as defined in claim 1 wherein the external fluid pressure is sufficient to prevent substantial bulging of the skin of the withdrawn portion of the billet.

9. A method is defined in claim 1 wherein said step of controlling includes elevating the pressure in the pouring chamber sufficiently to substantially terminate flow of molten metal through the nozzle.

10. A continuous casting apparatus comprising:

a mold having open upper and lower ends, said mold being adapted to have molten metal fed thereto through the open upper end thereof to thereby form a billet;

means in said mold for receiving a coolant to cool the molten metal whereby a peripheral region of the metal in the mold solidifies to form a skin;

means defining a pressure vessel with a passage extending therethrough, said passage being in communication with the lower end of the mold and adapted to receive the billet from the mold;

said pressure vessel having a plurality of pressure chambers along said passage and opening into said passage;

conduit means for supplying fluid under pressure to each of said pressure chambers;

means for individually controlling the pressure in each of said chambers whereby the pressure in said chambers can be different;

means defining a pouring chamber above the upper end of the mold whereby molten metal can be poured from a container through the pouring chamber and into the mold;

first valve means for controlling the pressure in the pouring chamber to thereby control the rate at which molten metal is poured into the mold.

11. An apparatus as defined in claim 10 including means in at least one of said pressure chambers for directing a spray of coolant against a portion of the billet in said one pressure chamber.

12. An apparatus as defined in claim 10 wherein said means for controlling the pressure in each of said chambers includes second valve means for controlling the pressure in each of said chambers, said apparatus including a control connection between said first and second valve means so that said second valve means maintains a higher pressure in the associated pressure chamber than the first valve means maintains in the pouring chamber.

* * * * *